US012234625B2

(12) United States Patent
Jin et al.

(10) Patent No.: US 12,234,625 B2
(45) Date of Patent: Feb. 25, 2025

(54) BACKHOE LOADER ENERGY RECOVERY AND REUSE SYSTEM AND CONTROL METHOD THEREOF, AND BACKHOE LOADER

(71) Applicant: JIANGSU XCMG CONSTRUCTION MACHINERY RESEARCH INSTITUTE LTD., Jiangsu (CN)

(72) Inventors: Weiwei Jin, Jiangsu (CN); Yanbo Geng, Jiangsu (CN); Mingshuai Li, Jiangsu (CN)

(73) Assignee: JIANGSU XCMG CONSTRUCTION MACHINERY RESEARCH INSTITUTE LTD., Jiangsu (CN)

( * ) Notice: Subject to any disclaimer, the term of this patent is extended or adjusted under 35 U.S.C. 154(b) by 0 days.

(21) Appl. No.: 18/252,914

(22) PCT Filed: Nov. 25, 2022

(86) PCT No.: PCT/CN2022/134331
§ 371 (c)(1),
(2) Date: May 15, 2023

(87) PCT Pub. No.: WO2024/108543
PCT Pub. Date: May 30, 2024

(65) Prior Publication Data
US 2024/0344296 A1 Oct. 17, 2024

(51) Int. Cl.
*E02F 9/22* (2006.01)

(52) U.S. Cl.
CPC ..... *E02F 9/2217* (2013.01); *E02F 9/2267* (2013.01)

(58) Field of Classification Search
CPC ..... F15B 21/14; F15B 1/024; E02F 9/2267; E02F 9/2217
See application file for complete search history.

(56) References Cited

U.S. PATENT DOCUMENTS 7,634,911 B2 * 12/2009 Brinkman ..... E02F 9/2217 91/533
2019/0203746 A1 * 7/2019 Balboni ..... F15B 1/027

FOREIGN PATENT DOCUMENTS

CN 101435451 A 5/2009
CN 102506010 A 6/2012
(Continued)

OTHER PUBLICATIONS

International Search Report from PCT/CN2022/134331 dated Aug. 14, 2023.
(Continued)

*Primary Examiner* — Abiy Teka
(74) *Attorney, Agent, or Firm* — Calfee, Halter & Griswold LLP

(57) ABSTRACT

The present disclosure relates to a backhoe loader energy recovery and reuse system and a control method thereof, and a backhoe loader, wherein the system comprises: an actuator, configured to drive a working device to perform an action with hydraulic oil as a medium, and having a first cavity and a second cavity; a reversing valve, having a first working oil port communicated with the first cavity and a second working oil port communicated with the second cavity, the reversing valve being configured to reverse the actuator; a stabilizing valve group, having a first oil port, a second oil port, a third oil port and a fourth oil port, the first oil port and the second oil port being communicated with the first cavity and the second cavity, respectively, and the third oil port being communicated with an oil tank; and an energy storage part, communicated with the fourth oil port and configured to store hydraulic energy; wherein the first oil port and the third oil port have a first communication state therebetween, in which the hydraulic oil in the first cavity can enter the oil tank; the second oil port and the fourth oil
(Continued)

port can be selectively connected or disconnected, and in a connected state, the second cavity is communicated with the energy storage part.

16 Claims, 3 Drawing Sheets

(56) References Cited

FOREIGN PATENT DOCUMENTS

| | | | | |
|---|---|---|---|---|
| CN | 110258684 | A | | 9/2019 |
| CN | 112681416 | A | * | 4/2021 |
| CN | 216430146 | U | | 5/2022 |
| CN | 217401304 | U | | 9/2022 |
| DE | 102014226377 | A1 | | 6/2016 |
| EP | 2557239 | A1 | | 2/2013 |
| EP | 3176444 | A1 | | 6/2017 |

OTHER PUBLICATIONS

Extended European Search Report from EP Application No. 22868447.8 dated Oct. 9, 2024.

* cited by examiner

BACKHOE LOADER ENERGY RECOVERY AND REUSE SYSTEM AND CONTROL METHOD THEREOF, AND BACKHOE LOADER

CROSS-REFERENCE TO RELATED APPLICATION

This application is the United States national phase entry of International Application No. PCT/CN2022/134331 filed on Nov. 25, 2022, the disclosure of which is hereby incorporated in its entirety by reference.

TECHNICAL FIELD

The present disclosure relates to the technical field of construction machinery, and particularly to a backhoe loader energy recovery and reuse system and a control method thereof, and a backhoe loader.

BACKGROUND

As a multi-functional construction machinery, the backhoe loader combines the characteristics of traditional excavators and loaders, and is widely used in municipal works, agriculture, forestry, water conservancy and other fields. At present, most of loading and excavation working devices of backhoe loaders in the market adopt hydraulic cylinders as the sources of action energy, and the number of the hydraulic cylinders of the whole machine ranges from 10 to 13. The excavation end adopts a rotary cylinder to drive the excavation working device to rotate, with a rotation angle generally less than or equal to 180° and a left-right steering angle of about 90°, and the rotation limit is rigid or semi-rigid.

The deadweight of the excavation working device is usually more than 1500 kg with an excavation cycle of about 12 seconds, while the moving speed is high during a rotation toward one side and kinetic energy of the working device is completely absorbed by the whole machine, resulting in problems such as shaking and displacement of the whole machine, which affect the handling comfort and the stability of the whole machine. Moreover, the excavation operation has a short cycle period and a high frequency, and the whole machine absorbs the kinetic energy of the working device for a long time and bears the collision, which will also affect the service lives of the chassis and the rotary structural parts. In addition, in a descending process of a loading arm and an excavation arm, potential energy is mostly converted into a temperature rise of hydraulic oil, which also results in energy waste.

SUMMARY

According to a first aspect of the present disclosure, there is provided a backhoe loader energy recovery and reuse system, comprising:

an actuator, configured to drive a working device of a backhoe loader to perform an action with hydraulic oil as a medium, the actuator having a first cavity and a second cavity:

a reversing valve, having a first working oil port communicated with the first cavity and a second working oil port communicated with the second cavity, the reversing valve being configured to reverse the actuator:

a stabilizing valve group, having a first oil port, a second oil port, a third oil port and a fourth oil port, the first oil port and the second oil port being communicated with the first cavity and the second cavity, respectively, and the third oil port being communicated with an oil tank; and an energy storage part, communicated with the fourth oil port and configured to store hydraulic energy:

wherein the first oil port and the third oil port have a first communication state therebetween, in the first communication state, the hydraulic oil in the first cavity can enter the oil tank: the second oil port and the fourth oil port can be selectively connected or disconnected, and in a connected state, the second cavity is communicated with the energy storage part.

In some embodiments, the stabilizing valve group comprises:

a first control valve, having a first position and a second position, the first control valve being configured to make the first oil port and the third oil port in the first communication state when being in the first position, and make the first oil port and the third oil port in a second communication state when being in the second position to prevent the hydraulic oil in the first cavity from entering the oil tank; and a second control valve, having a first position and a second position, the second control valve being configured to make the second oil port and the fourth oil port in the connected state when being in the first position, and make the second oil port and the fourth oil port in a disconnected state when being in the second position.

In some embodiments, the first control valve is a two-position two-way reversing valve, and a first check valve is disposed on an oil path in a second position between the first oil port and the third oil port, and the first check valve is configured to only allow the hydraulic oil to flow from the third oil port to the second oil port.

In some embodiments, the second control valve is a two-position two-way reversing valve, a second check valve and a third check valve are disposed on an oil path in a second position between the second oil port and the fourth oil port, the second check valve and the third check valve are oppositely disposed, so that the second oil port and the fourth oil port are in the disconnected state when the second control valve is in the second position.

In some embodiments, in case that the first control valve is in the first position and the second control valve is in the first position, the actuator simultaneously performs an oil return and an energy recovery or reuse:

in case that the first control valve is in the second position and the second control valve is in the first position, the actuator only performs the energy recovery or reuse; and in case that the first control valve is in the first position and the second control valve is in the second position, the actuator only performs the oil return.

In some embodiments, the first control valve and the second control valve are electromagnetic valves, and the backhoe loader energy recovery and reuse system further comprises a controller configured to control the first control valve and the second control valve to switch working positions.

In some embodiments, the backhoe loader energy recovery and reuse system further comprises a state switch which can be selectively in an open state or a closed state, the state switch being configured to control the stabilizing valve group through the controller to start an energy recovery or reuse in the open state and stop the energy recovery or reuse in the closed state.

In some embodiments, the state switch is configured to be in the closed state when a motion range of the actuator does not exceed a preset range, or a moving speed does not exceed a preset speed, or a load does not exceed a preset load; and in the open state in case that the motion range of the actuator exceeds the preset range, or the moving speed exceeds the preset speed, or the load exceeds the preset load.

In some embodiments, the actuator comprises:

a derricking cylinder configured to drive an excavation arm or a loading arm to rotate in a vertical plane; and/or two rotary cylinders, which are disposed in series and configured to extend and retract to cooperate with driving of a rotary body of the backhoe loader to rotate.

In some embodiments, the actuator comprises a derricking cylinder configured to drive an excavation arm or a loading arm to rotate in a vertical plane: the backhoe loader energy recovery and reuse system further comprises a detection component which comprises:

a first displacement sensor, configured to detect a displacement of a piston rod of the derricking cylinder; and a first pressure sensor, configured to detect a pressure in the first cavity of the derricking cylinder.

In some embodiments, the stabilizing valve group is configured to communicate the second cavity with the energy storage part when a detection value of the first displacement sensor exceeds a first preset displacement and a detection value of the first pressure sensor exceeds a first preset pressure.

In some embodiments, the actuator comprises: two rotary cylinders configured to extend and retract to cooperate with driving of a rotary body of the backhoe loader to rotate: the backhoe loader energy recovery and reuse system further comprises a detection component which comprises:

a second displacement sensor, configured to detect a displacement of a piston rod of the rotary cylinder:

a second pressure sensor, configured to detect a pressure in the first cavity of the rotary cylinder; and a position detection sensor, configured to detect a rotation angular position of the rotary body.

In some embodiments, the stabilizing valve group is configured to communicate the second cavity with the energy storage part to store energy for the energy storage part, when the rotary body swings out to an angle greater than a preset angle and a detection value of the second pressure sensor exceeds a second preset pressure; and communicate the first cavity with the energy storage part to supplement hydraulic oil to the rotary cylinder through the energy storage part, when the rotary body swings back to an angle less than the preset angle and the detection value of the second pressure sensor does not exceed the second preset pressure.

According to a second aspect of the present disclosure, there is provided a backhoe loader, comprising the backhoe loader energy recovery and reuse system in any one of the above embodiments.

According to a third aspect of the present disclosure, there is provided a control method of a backhoe loader energy recovery and reuse system, comprising:

receiving a working state of the actuator and/or the working device detected by a detection component; and in case that a detection result of the detection component reaches a preset condition, making the stabilizing valve group in a state of communicating the second cavity with the energy storage part.

In some embodiments, the actuator comprises a derricking cylinder configured to drive an excavation arm or a loading arm to rotate in a vertical plane: when a detection result of the detection component reaches a preset condition, making the stabilizing valve group in a state of communicating the second cavity with the energy storage part comprises:

in case that a displacement of a piston rod of the derricking cylinder detected by a first displacement sensor exceeds a first preset displacement, and a pressure in the derricking cylinder detected by a first pressure sensor exceeds a first preset pressure, making the stabilizing valve group in a state of communicating the second cavity with the energy storage part.

In some embodiments, the actuator comprises: two rotary cylinders configured to extend and retract to cooperate with driving of a rotary body of the backhoe loader to rotate: in case that a detection result of the detection component reaches a preset condition, making the stabilizing valve group in a state of communicating the second cavity with the energy storage part comprises:

receiving a displacement signal of a piston rod of the rotary cylinder detected by a second displacement sensor to determine a rotation direction of the rotary body:

in a swing out process of the rotary body, in case that a swing angle detected by a position detection sensor exceeds a preset angle and a pressure in the rotary cylinder detected by a second pressure sensor exceeds a second preset pressure, making the stabilizing valve group in a state of communicating the second cavity with the energy storage part to store energy for the energy storage part.

In some embodiments, in case that a detection result of the detection component reaches a preset condition, making the stabilizing valve group in a state of communicating the second cavity with the energy storage part further comprises:

in a swing back process of the rotary body, when the swing angle detected by the position detection sensor does not exceed the preset angle and the pressure in the swing cylinder detected by the second pressure sensor does not exceed the second preset pressure, making the stabilizing valve group in a state of communicating the first cavity with the energy storage part, so as to supplement hydraulic oil to the swing cylinder through the energy storage part.

BRIEF DESCRIPTION OF THE DRAWINGS

In order to more clearly illustrate the technical solutions in the embodiments of the present disclosure or in the prior art, the drawings to be used in the description of the embodiments or the prior art will be briefly introduced below. Obviously, the drawings used in the following description only illustrate some embodiments of the present disclosure, and other drawings can be obtained by those of ordinary skills in the art according to these drawings without paying any creative labor.

REFERENCE NUMERALS

Figure 1:
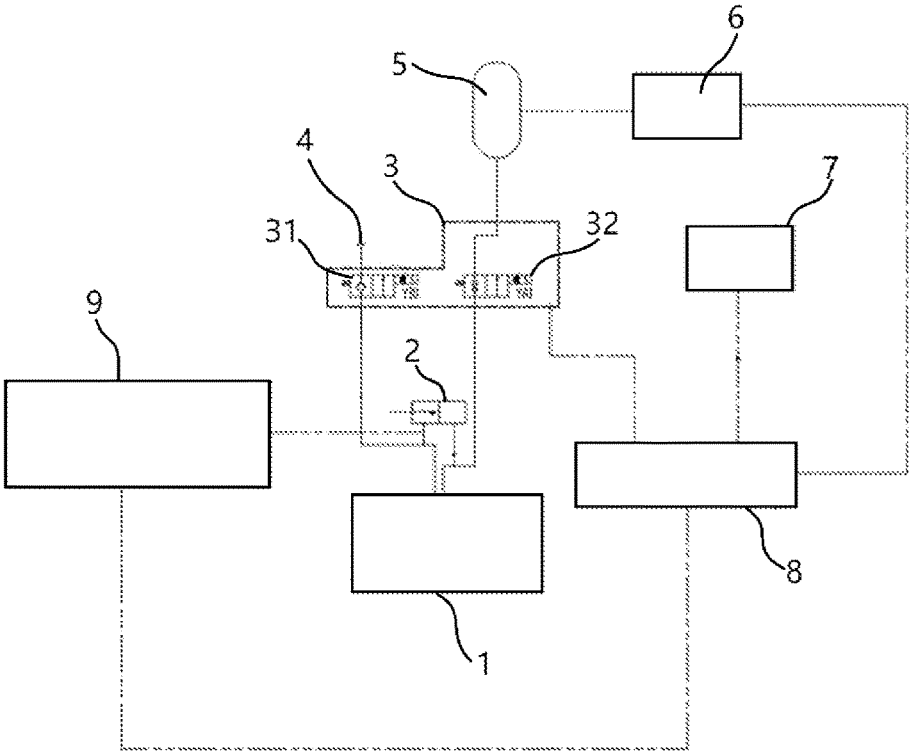
FIG. 1 is a schematic diagram of working principles of some embodiments of a backhoe loader energy recovery and reuse system of the present disclosure.

1, reversing valve; 2, actuator; 2A, derricking cylinder; 2B, rotary cylinder; 3, stabilizing valve group; 31, control valve; 311, first check valve; 312, first electromagnetic coil; 32, second control valve; 321, second check valve; 322, third check valve; 323, second electromagnetic coil; 4, oil tank; 5, energy storage part; 6, pressure detection part; 7, state switch; 8, controller; 81, data receiver; 82, electronic control unit; 9, detection component; 91, first displacement sensor; 92, first pressure sensor; 93, second displacement sensor; 94, second pressure sensor; 95, position detection sensor.

DETAILED DESCRIPTION

The technical solutions in the embodiments of the present disclosure will be described clearly and completely with reference to the drawings in the embodiments of the present disclosure. Obviously, those described are only a part, rather than all, of the embodiments of the present disclosure. The following description of at least one exemplary embodiment is merely illustrative in nature and is in no way intended to limit the present disclosure or its application or use. Based on the embodiments of the present disclosure, any other embodiment obtained by those of ordinary skills in the art without paying any creative labor should fall within the protection scope of the present disclosure.

The technologies, methods and devices known to those of ordinary skill in related arts may not be discussed in detail, but should be considered as parts of the specification where appropriate.

In the description of the present disclosure, it should be understood that orientational or positional relationships indicated by the terms 'central', 'lateral', 'longitudinal', 'front', 'rear', 'left', 'right', 'upper', 'lower', 'vertical', 'horizontal', 'top', 'bottom', 'inner' and 'outer' are based on the drawings, only for the convenience of describing the present disclosure and simplifying the description, rather than indicating or implying that a referred device or element must have a particular orientation, or be constructed and operated in a particular orientation, and they should not be construed as limitations to the protection scope of the present disclosure.

In the description of the present disclosure, it should be understood that the use of the terms "first", "second" and the like to define components is merely for the convenience of the distinguishing between corresponding components, and unless otherwise stated, those terms have no special meaning and therefore should not be construed as limiting the protection scope of the present disclosure.

The rotary working device for the excavation by the existing backhoe loader mainly includes a backhoe frame, a rotary body, a rotary cylinder and a working linkage. The rotary body and the rotary cylinder are mounted on the backhoe frame. During an excavation operation, the rotary cylinder provides a rotation force for the rotary body to generate a rotation moment, and the rotary body drives the working linkage and a load thereof for a reciprocating rotary motion around the backhoe frame. There are usually two rotary cylinders, and when the rotary body starts to rotate, one of the two rotary cylinders generates a thrust force and the other generates a tensile force, thus providing an enough torque for the rotation of the working device.

When the rotary body and the backhoe frame move to form a certain angle, the two cylinders generate two torques with opposite directions, thus reducing the operation speed of the working device and absorbing the potential energy thereof to a certain extent, and in cooperation with the rigid limit on the backhoe frame, stop the motion of the rotary body at a final position.

In addition, in a descending process of a loading arm and an excavation arm of the backhoe loader, the working device will have a large impact on the whole machine when stopping moving, because of its large mass and fast descending speed. At present, the moving speed of the working device is reduced by increasing the oil return back pressure of the cylinder.

The inventor has noticed that the current way of reducing the moving speed of the working device has the following disadvantages:

In the motion process of the rotary body of the excavation working device, when the two rotary cylinders produce opposite rotation moments for the rotary body, an overflow will occur in one of the rotary cylinders, resulting in the rise of the oil temperature of the hydraulic system. Moreover, due to the structural limitation, a rigid limit block on the backhoe frame will not have a large resistance moment to the rotary body, such that the rotary body and the backhoe frame both bear large forces, which will affect the service lives of the backhoe frame and the rotary body to some extent. In addition, the buffering is mainly achieved by the rigid limit, but the shake of the whole machine increases in case of the rigid limit.

In the descending process of the loading arm and the excavation arm, the increase of the oil return back pressure of the cylinder causes the rise of the oil temperature of the hydraulic system, which results in the energy waste.

In view of the above defects and disadvantages in the prior art, an objective of the present disclosure is to propose a backhoe loader energy recovery and reuse system, which can solve the problems of the large impact when the backhoe loader rotates to an extreme position during the rotation operation, the poor handling comfort of the excavation rotation, and the energy waste caused when the loading arm and the excavation arm descend.

The present disclosure provides a backhoe loader energy recovery and reuse system and a control method thereof, and a backhoe loader, which can reduce the energy waste in the operation process of the backhoe loader.

The backhoe loader energy recovery and reuse system in the embodiments of the present disclosure controls the stabilizing valve group to realize the recovery or reuse of the hydraulic energy in the action process of the actuator, which reduces the energy waste and makes full use of the energy in operation process of the backhoe loader. Moreover, the energy storage part absorbs the impact on the frame from the kinetic energy of the working device in the rotation process or from the potential energy in the descending process, so as to improve the stability and the handling comfort of the whole machine, optimize the stress condition of the actuator, avoid the overflow of the actuator, reduce the temperature rise of the hydraulic oil and strengthen the environmental adaptability of the whole machine.

Figure 2:
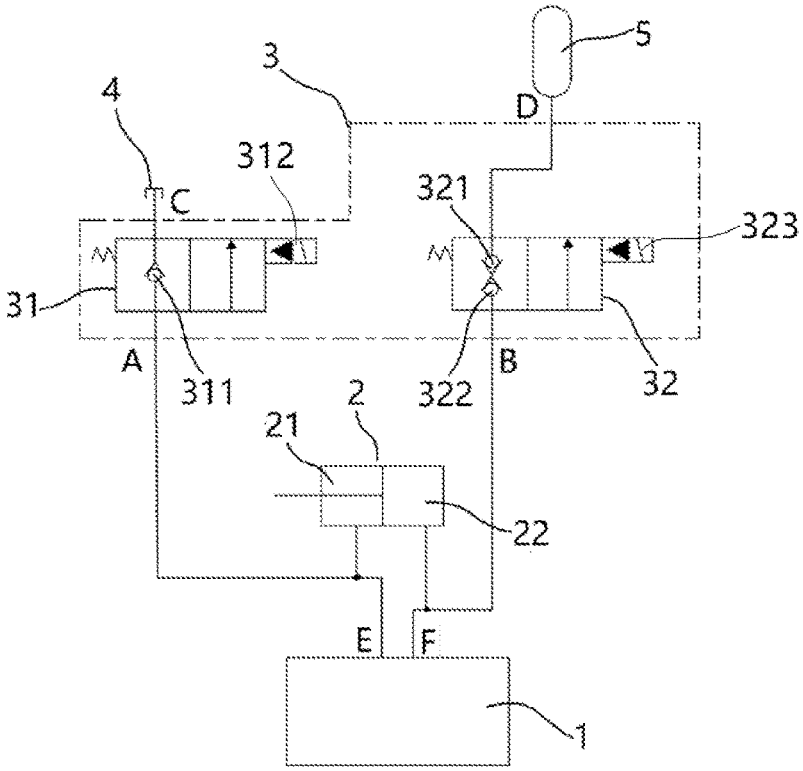
FIG. 2 is a schematic diagram of connection relationships between a stabilizing valve group, an actuator and an energy storage part in FIG. 1.

In some embodiments, as illustrated in FIGS. 1 and 2, a backhoe loader energy recovery and reuse system of the present disclosure includes an actuator 2, a reversing valve 1, a stabilizing valve group 3, and an energy storage part 5.

The actuator 2 is configured to drive a working device of a backhoe loader with hydraulic oil as a medium, the actuator having a first cavity 21 and a second cavity 22. The working device of the backhoe loader may be a rotary body, an excavation arm or a loading arm. The actuator 2 may be a cylinder, the first cavity 21 of which is provided with a rod, and the second cavity 22 of which has no cavity. Alternatively, the actuator 2 may be a motor.

The reversing valve 1 includes a first working oil port E communicated with the first cavity 21, and a second working oil port F communicated with the second cavity 22, the reversing valve 1 being configured to reverse the actuator 2. The stabilizing valve group 3 includes a first oil port A, a second oil port B, a third oil port C and a fourth oil port D, the first oil port A and the second oil port B being communicated with the first cavity 21 and the second cavity 22, respectively, and the third oil port C being communicated with an oil tank 4. Different actuators 2 may be correspondingly provided with different reversing valves 1, and different oil ports may be connected to each other through a buckle rubber hose.

The energy storage part 5 is communicated with the fourth oil port D and is configured to store hydraulic energy. For example, the energy storage part 5 may be an accumulator. The energy storage part 5 may be provided with a pressure detection part 6, which stops the energy storage when a pressure in the energy storage part 5 exceeds a preset pressure, so as to improve the use safety of the energy storage part 5.

In which, the first oil port A and the third oil port C have a first communication state therebetween, in the first communication state, the hydraulic oil in the first cavity 21 can enter the oil tank 4 to normally return to the oil tank 4. The second oil port B and the fourth oil port D can be selectively connected or disconnected, and in a connected state, the second cavity 22 is communicated with the energy storage part 5, so that the hydraulic oil in the second cavity 22 can enter the energy storage part 5 to realize an energy recovery, or the hydraulic oil in the energy storage part 5 can enter the second cavity 22 to assist the actuator 2 to act to realize an energy reuse.

In this embodiment, the stabilizing valve group 3 is controlled in the action process of the actuator 2 to realize the recovery or reuse of the hydraulic energy, which reduces the energy waste and makes full use of the energy in the operation process of the backhoe loader. Moreover, the energy storage part 5 absorbs the impact on the frame from the kinetic energy of the working device in the rotation process or from the potential energy in the descending process, so as to improve the stability and the handling comfort of the whole machine, optimize the stress condition of the actuator 2, prolong the service life of the whole machine, avoid the overflow of the actuator 2, reduce the temperature rise of the hydraulic oil and strengthen the environmental adaptability of the whole machine. In addition, the system flexibly absorbs energy through the energy storage part 5, rather than relying on the rigid limit, so that the operation is more stable and the shake of the whole machine during operation is reduced.

In some embodiments, as illustrated in FIGS. 1 and 2, the stabilizing valve group 3 includes:

a first control valve 31, having a first position and a second position, the first control valve 31 being configured to make the first oil port A and the third oil port C in the first communication state when being in the first position, and make the first oil port A and the third oil port C in a second communication state when being in the second position to prevent the hydraulic oil in the first cavity 21 from entering the oil tank 4; and a second control valve 32, having a first position and a second position, the second control valve 32 being configured to make the second oil port B and the fourth oil port D in the connected state when being in the first position, and make the second oil port B and the fourth oil port D in a disconnected state when being in the second position.

In which, the first oil port A and the third oil port C of the stabilizing valve group 3 correspond to the first control valve 31. When the first control valve 31 is in the first position (the right position in FIG. 2), the first oil port A and the third oil port C are in the first communication state, and the hydraulic oil in the first cavity 21 can return to the oil tank 4. When the first control valve 31 is in the second position (the left position in FIG. 2), the first oil port A and the third oil port C are in the second communication state, and the hydraulic oil in the first cavity 21 cannot enter the oil tank 4. At this time, the normal oil return in the working process of the actuator 2 can be cut off for the energy recovery or reuse.

The second oil port B and the fourth oil port D of the stabilizing valve group 3 correspond to the second control valve 32. When the second control valve 32 is in the first position (the right position in FIG. 2), the second oil port B and the fourth oil port D are in the connected state, thus allowing the energy recovery or reuse in the working process of the actuator 2. When the second control valve 32 is in the second position (the left position in FIG. 2), the second oil port B and the fourth oil port D are in the disconnected state, thus cutting off the energy recovery or reuse.

In this embodiment, the structure and the design difficulty of the stabilizing valve group 3 can be simplified by setting the stabilizing valve group 3 as a combination of the first control valve 31 and the second control valve 32. Moreover, the two functional modules for the direct oil return of the actuator 2 and the energy recovery or reuse are independently structured and controlled, which can avoid the mutual influence between the two functional modules, increase the working reliability of the backhoe loader, and improve the selection flexibility of the working mode of the actuator 2.

In some embodiments, as illustrated in FIG. 2, the first control valve 31 is a two-position two-way reversing valve: a first check valve 311 is disposed on an oil path in a second position between the first oil port A and the third oil port C: the first check valve 311 is configured to only allow the hydraulic oil to flow from the third oil port C to the second oil port B.

In this embodiment, in case that the first control valve 31 is switched to the second position, the hydraulic oil in the first cavity 21 can be prevented from directly being returned, and the hydraulic oil can be supplemented from the oil tank 4 when the first cavity 21 is empty, thus improving the stability of the action of the actuator 2.

In some embodiments, as illustrated in FIG. 2, the second control valve 32 is a two-position two-way reversing valve: a second check valve 321 and a third check valve 322 are disposed on an oil path in a second position between the second oil port B and the fourth oil port D: the second check valve 321 and the third check valve 322 are oppositely disposed, so that the second oil port B and the fourth oil port D are in the disconnected state in case that the second control valve 32 is in the second position.

In this embodiment, the communication between the second cavity 22 and the energy storage part 5 can be cut off in case that the second control valve 32 is in the second position. This structure can reliably and conveniently control whether to enter the energy recovery or reuse mode according to the working requirement, thus realizing the energy recovery or reuse of the backhoe loader without affecting the realization of the original function.

In some embodiments, the stabilizing valve group 3 enables the actuator 2 to realize the following functional modes:

- in case that the first control valve 31 is in the first position and the second control valve 32 is in the first position, the actuator 2 simultaneously performs an oil return and an energy recovery or reuse, and some of the hydraulic oil is returned while some realizes the energy recovery or reuse:
- in case that the first control valve 31 is in the second position and the second control valve 32 is in the first position, the actuator 2 only performs the energy recovery or reuse, and the hydraulic oil in the first cavity 21 is not returned to the oil tank 4; and
- in case that the first control valve 31 is in the first position and the second control valve 32 is in the second position, the actuator 2 only performs the oil return without the energy recovery or reuse.

In this embodiment, the first control valve 31 and the second control valve 32 can be independently controlled, so that the actuator 2 can flexibly realize different working modes according to the actual working conditions.

In some embodiments, both the first control valve 31 and the second control valve 32 are electromagnetic valves, and the backhoe loader energy recovery and reuse system further includes a controller 8 configured to control the first control valve 31 and the second control valve 32 to switch working positions.

In this embodiment, the first control valve 31 and the second control valve 32 are provided as electromagnetic valves, and can be automatically controlled according to the working conditions, so as to conveniently select the working mode of the actuator 2, and improve the switching speed between the working modes.

Figure 4:
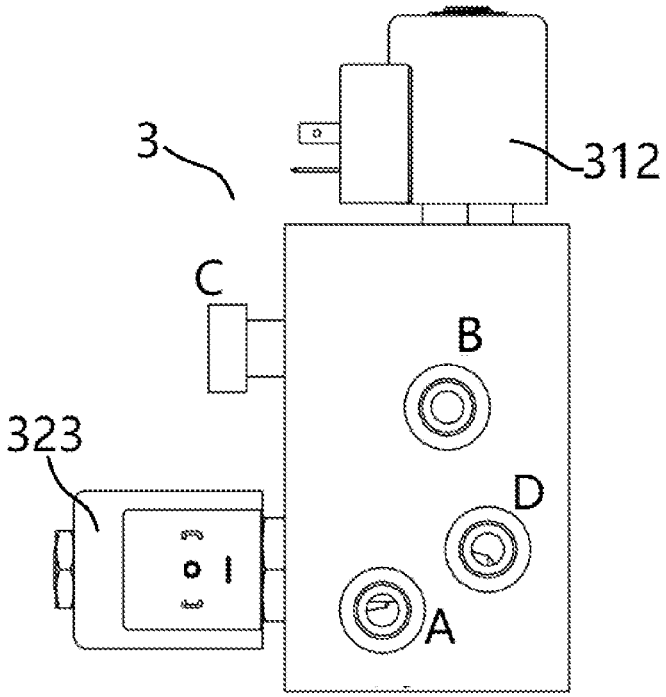
FIG. 4 is a diagram of outlines of some embodiments of a stabilizing valve group in a backhoe loader energy recovery and reuse system of the present disclosure.

As illustrated in FIG. 4, the valve body of the stabilizing valve group 3 is provided with a first oil port A, a second oil port B, a third oil port C and a fourth oil port D. In addition, the valve body is also provided with a first electromagnetic coil 312 and a second electromagnetic coil 323.

In some embodiments, the backhoe loader energy recovery and reuse system further includes a state switch 7 which can be selectively in an open state or a closed state. The state switch 7 is configured to control the stabilizing valve group 3 through the controller 8, so as to start the energy recovery or reuse in the open state and stop the energy recovery or reuse in the closed state.

For example, the state switch 7 may be a two-position self-positioning switch with a function of keeping the current position.

In this embodiment, it may be independently selected whether to apply the energy recovery and reuse system through the state switch 7 according to the actual working conditions, which not only keeps the original working mode of the backhoe loader, but also starts the energy recovery or reuse when needed.

In some embodiments, the state switch 7 is configured to be in the closed state in case that a motion range of the actuator 2 does not exceed a preset range, or a moving speed does not exceed a preset speed, or a load docs not exceed a preset load; and in the open state in case that the motion range of the actuator 2 exceeds the preset range, or the moving speed exceeds the preset speed, or the load exceeds the preset load.

In this embodiment, through the state switch 7 it may be selected not to connect the energy recovery and reuse system and keep the original working mode when the actuator 2 has a small motion displacement, or a small moving speed or a light load. The working device has a large impact on the machine body and also wastes much energy during the motion when the actuator 2 has a large motion displacement, a large moving speed or a heavy load. At this time, through the state switch 7, it is selected to connect the energy recovery system to reduce the impact generated by the working device and the energy waste.

Figure 3:
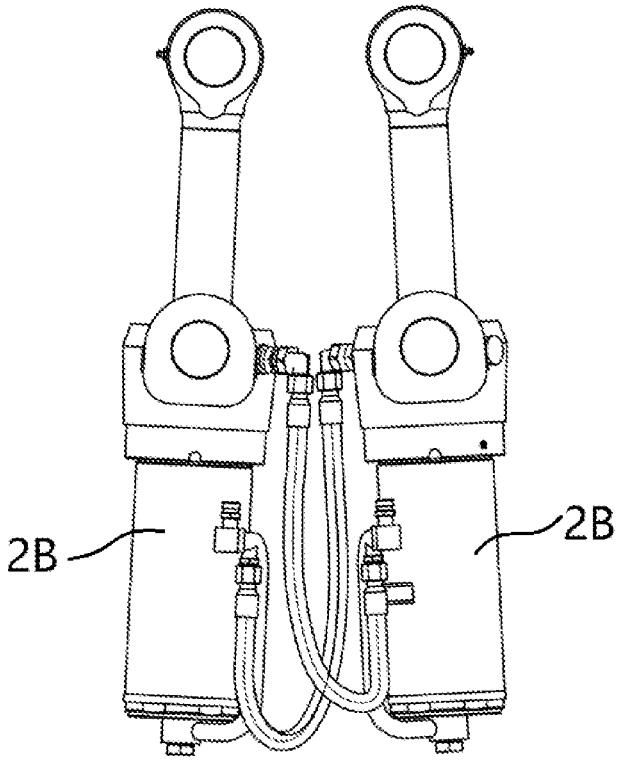
FIG. 3 is a schematic diagram of a connection between two rotary cylinders in a backhoe loader energy recovery and reuse system of the present disclosure.

In some embodiments, the actuator 2 includes a derricking cylinder 2A configured to drive an excavation arm or a loading arm to rotate in a vertical plane; and/or two rotary cylinders 2B, which are disposed in series and configured to extend and retract to cooperate with driving of a rotary body of the backhoe loader to rotate. As illustrated in FIG. 3, the first cavity 21 of one of the two rotary cylinders 2B is communicated with the second cavity 22 of the other rotary cylinder 2B.

In which, the excavation arm and the loading arm will waste the potential energy in the descending process, and the potential energy can be recovered and reused by the system of the present disclosure. The rotary body may drive the excavation arm to rotate, so as to realize a rotary excavation function. In the rotation process, if the rotary body has a high moving speed and a heavy load, or rotates outwards to an extreme position, a large impact will be caused on the machine body, and the kinetic energy may be recovered and reused by the system of the present disclosure.

In some embodiments, as illustrated in FIG. 1, the backhoe loader energy recovery and reuse system further includes a detection component 9 configured to detect a working state of the actuator 2 and the working device, so that the stabilizing valve group 3 is in a state of communicating the second cavity 22 with the energy storage part 5 when a detection result of the detection component 9 reaches a preset condition.

In this embodiment, the detection component 9 monitors the working state of the actuator 2 and/or the working device in real time to accurately determine an opportunity of starting the energy recovery and reuse system.

In some embodiments, the actuator 2 includes a derricking cylinder 2A configured to drive an excavation arm or a loading arm to rotate in a vertical plane. The detection component 9 includes a first displacement sensor 91 and a first pressure sensor 92 configured to detect a displacement of a piston rod of the derricking cylinder 2A; and a first pressure sensor 92 configured to detect a pressure in the first cavity 21 of the derricking cylinder 2A.

In this embodiment, the working state of the actuator 2 can be detected through the first displacement sensor 91 and the first pressure sensor 92, and the opportunity of the recovery and reuse of the potential energy can be determined according to the working state in the descending process of the excavation arm or the loading arm.

In some embodiments, the stabilizing valve group 3 is configured to communicate the second cavity 22 with the energy storage part 5 in case that a detection value of the first displacement sensor 91 exceeds a first preset displacement and a detection value of the first pressure sensor 92 exceeds a first preset pressure.

In this embodiment, the potential energy in the descending process can be absorbed by the energy storage part 5 in case that the excavation arm or the loading arm descends greatly under a heavy loaded, thus reducing the energy waste. The energy recovered by the energy storage part 5 may be provided to other actuators 2.

In some embodiments, the actuator 2 includes two rotary cylinders 2B configured to extend and retract to cooperate with driving of a rotary body of the backhoe loader to rotate. The detection component 9 includes a second displacement sensor 93 configured to detect a displacement of a piston rod of the rotary cylinder 2B, a second pressure sensor 94 configured to detect a pressure in the first cavity 21 of the rotary cylinder 2B, and a position detection sensor 95 configured to detect a rotation angular position of the rotary body. Each of the rotary cylinders 2B may be correspondingly provided with the second displacement sensor 93 and the second pressure sensor 94, and the position detection sensor 95 may detect a rotation angle of the rotary body in real time, or two angle detection switches may be disposed on two sides of a central plane, and triggered when the rotary body swings to a position of the angle detection switch.

In this embodiment, the working state of the actuator 2 may be detected through the second displacement sensor 93, the second pressure sensor 94 and the position detection sensor 95, and the opportunity of the recovery and reuse of the kinetic energy may be determined according to the working state in the rotation process of the rotary body, so as to reduce the impact on the machine body and the energy waste.

In some embodiments, the stabilizing valve group 3 is configured to communicate the second cavity 22 with the energy storage part 5 to store energy for the energy storage part 5 in case that the rotary body swings out to an angle greater than a preset angle and a detection value of the second pressure sensor 94 exceeds a second preset pressure, and communicate the first cavity 21 with the energy storage part 5 to supplement hydraulic oil to the rotary cylinder 2B through the energy storage part 5 in case that the rotary body swings back to an angle less than the preset angle and the detection value of the second pressure sensor 94 does not exceed the second preset pressure. For example, the preset angle is a swing angle relative to the central plane, such as 45°.

The rotation direction of the rotary body may be judged through the displacement of the rotary cylinder 2B detected by the second displacement sensor 93, so as to determine whether the rotary body is in a swing out state or a swing back state, wherein 'swing out' refers to a gradual increase of the swing angle of the excavation arm relative to the central plane, and the 'swing back' refers to a gradual decrease of the swing angle of the excavation arm relative to the central plane.

In this embodiment, in case that the excavation arm is under a heavy load and the rotary body swings out to a preset angle, in order to reduce the impact of the kinetic energy of the rotary body on the machine body, the second cavity 22 is communicated with the energy storage part 5 to absorb the hydraulic energy of the second cavity 22, thus reducing the kinetic energy of the rotary body and realizing the flexible deceleration of the rotary body: so as to reduce the impact on the machine body and improve the stability of the action of the whole machine. When the excavation arm is under a light load and the rotary body swings back to an angle less than the preset angle, the hydraulic oil may be supplemented to the rotary cylinder 2B through the energy storage part 5 to accelerate the rotary body to rotate back to a central plane, thus reducing the idle travel time of the working device and improving the operation efficiency of the backhoe loader.

Figure 5:
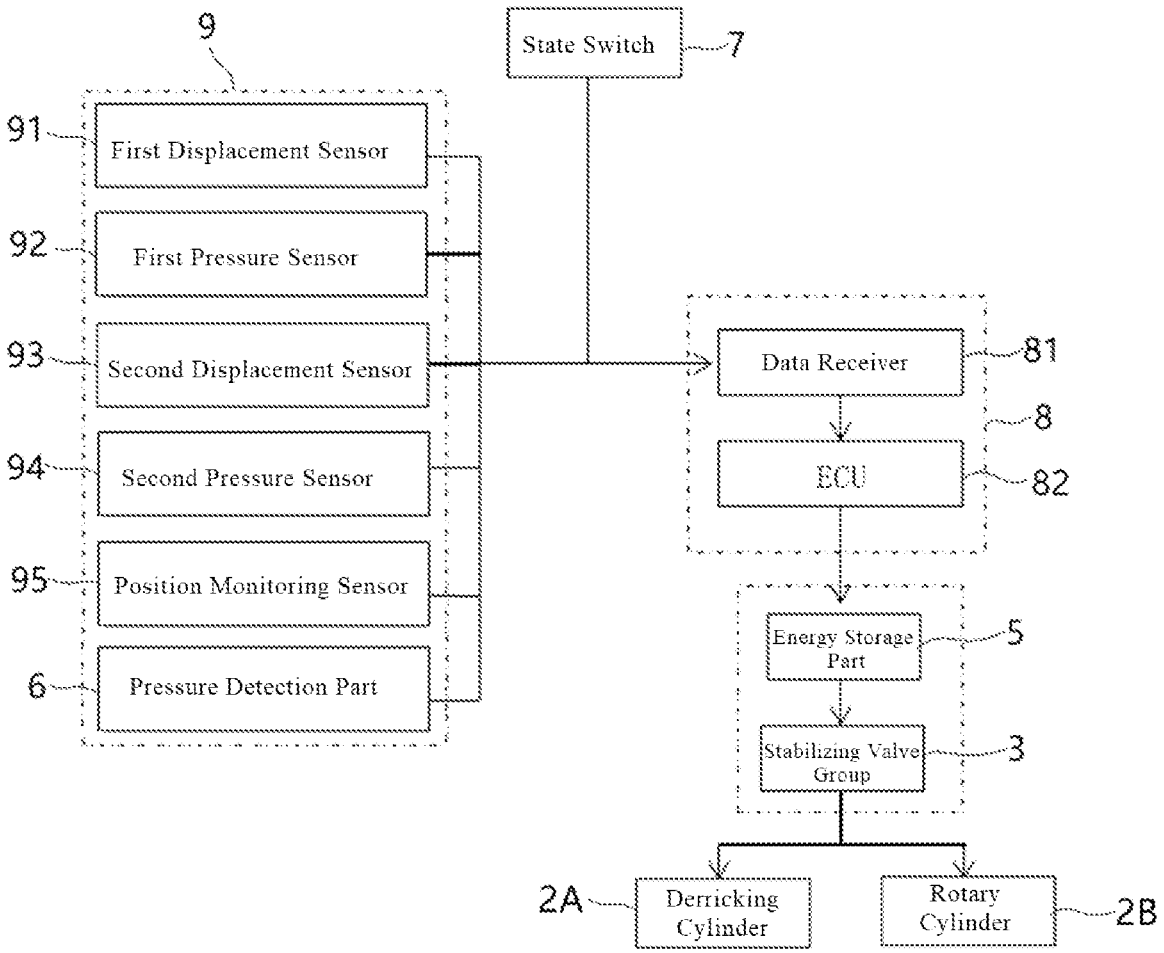
FIG. 5 is a schematic diagram of module compositions of some embodiments of a backhoe loader energy recovery and reuse system of the present disclosure.

In some embodiments, as illustrated in FIG. 5, the controller 8 includes a data receiver 81 and an electronic control unit 82. The data receiver 81 is configured to receive signals from the detection component 9 and the state switch 7, the state switch 7 is configured to select whether to connect the energy recovery and reuse system, and the detection component 9 is configured to detect the working state of the working device and/or the actuator 2. The electronic control unit 82 is configured to judge the signals received by the data receiver 81, and if a preset condition is met, control the stabilizing valve group 3 to communicate the second cavity 22 of the actuator 2 with the energy storage part 5, so as to recover and reuse the energy. The data receiver 81 and the electronic control unit 82 serve as energy reuse analysis units, and the energy storage part 5 and the stabilizing valve group 3 serve as energy reuse units.

In which, the detection component 9 includes a first displacement sensor 91, a first pressure sensor 92, a second displacement sensor 93, a second pressure sensor 94, a position detection sensor 95 and/or a pressure detection part 6, wherein the pressure detection part 6 is configured to detect the pressure in the energy storage part 5.

Next, the present disclosure provides a backhoe loader, including the backhoe loader energy recovery and reuse system of the above embodiments.

In this embodiment, the recovery or reuse of the hydraulic energy can be realized in the action process of the actuator 2, which reduces the energy waste and makes full use of the energy in the operation process of the backhoe loader. Moreover, the energy storage part 5 absorbs the impact on the frame from the kinetic energy of the working device in the rotation process or from the potential energy in the descending process, so as to improve the stability and the handling comfort of the whole machine, optimize the stress condition of the actuator 2, prolong the service life of the whole machine, and strengthen the environmental adaptability of the whole machine. In addition, the system can flexibly absorb energy through the energy storage part 5, which can make the operation more stable and reduce the shaking of the whole machine during operation.

Next, the present disclosure provides a control method of a backhoe loader energy recovery and reuse system based on the above embodiments. In some embodiments, the control method includes:

receiving a working state of the actuator 2 and/or the working device detected by a detection component 9; and in case that a detection result of the detection component 9 reaches a preset condition, making the stabilizing valve group 3 in a state of communicating the second cavity 22 with the energy storage part 5.

In this embodiment, the detection component 9 monitors the working state of the actuator 2 and/or the working device in real time to accurately determine the opportunity of starting the energy recovery and reuse system.

In some embodiments, the actuator 2 includes a derricking cylinder 2A configured to drive an excavation arm or a loading arm to rotate in a vertical plane: when a detection result of the detection component 9 reaches a preset condition, making the stabilizing valve group 3 in a state of communicating the second cavity 22 with the energy storage part 5 includes:

in case that a displacement of a piston rod of the derricking cylinder 2A detected by a first displacement sensor 91 exceeds a first preset displacement, and a pressure in the derricking cylinder 2A detected by a first pressure sensor 92 exceeds a first preset pressure, making the stabilizing valve group 3 in a state of communicating the second cavity 22 with the energy storage part 5.

In this embodiment, the working state of the actuator 2 can be detected through the first displacement sensor 91 and the first pressure sensor 92, and the opportunity of the recovery and reuse of the potential energy can be determined according to the working state in the descending process of the excavation arm or the loading arm.

In some embodiments, the actuator 2 includes two rotary cylinders 2B configured to extend and retract to cooperate with driving of a rotary body of the backhoe loader to rotate: in case that a detection result of the detection component 9 reaches a preset condition, making the stabilizing valve group 3 in a state of communicating the second cavity 22 with the energy storage part 5 includes:

receiving a displacement signal of a piston rod of the rotary cylinder 2B detected by the second displacement sensor 93 to determine a rotation direction of the rotary body:

in a swing out process of the rotary body, in case that a swing angle detected by the position detection sensor 95 exceeds a preset angle and a pressure in the rotary cylinder 2B detected by the second pressure sensor 94 exceeds a second preset pressure, making the stabilizing valve group 3 in a state of communicating the second cavity 22 with the energy storage part 5 to store energy for the energy storage part 5.

In this embodiment, in case that the excavation arm is under a heavy load and the rotary body swings out to a preset angle, in order to reduce the impact of the kinetic energy of the rotary body on the machine body, the second cavity 22 is communicated with the energy storage part 5 to absorb the hydraulic energy of the second cavity 22, thus reducing the kinetic energy of the rotary body and realizing the flexible deceleration of the rotary body, so as to reduce the impact on the machine body and improve the stability of the whole machine.

In some embodiments, in case that a detection result of the detection component 9 reaches a preset condition, making the stabilizing valve group 3 in a state of communicating the second cavity 22 with the energy storage part 5 includes:

in a swing back process of the rotary body, in case that the swing angle detected by the position detection sensor 95 does not exceed the preset angle, and the pressure in the swing cylinder 2B detected by the second pressure sensor 94 does not exceed the second preset pressure, making the stabilizing valve group 3 in a state of communicating the first cavity 21 with the energy storage part 5 to supplement hydraulic oil to the swing cylinder 2B through the energy storage part 5.

In this embodiment, in case that the excavation arm is under a light load and the rotary body swings back to an angle less than the preset angle, the hydraulic oil can be supplemented to the rotary cylinder 2B through the energy storage part 5, so as to accelerate the rotary body to rotate back to the central plane, thus reducing the idle travel time of the working device and improving the operation efficiency of the backhoe loader.

Some specific embodiments of the control method of the present disclosure are given below. In case that the backhoe loader needs to work, the whole machine is powered on and started, and the signals of the sensors in the detection component 9 are obtained by the controller 8 to judge the state of the whole machine. Through the state switch 7, the user switches the energy recovery and reuse system to the working mode according to the actual working condition: the user manipulates the working device to move, and the controller 8 independently judges the opportunity for the energy recovery or reuse through the detection data of the detection component 9. Under one condition, the hydraulic energy is only stored, and the hydraulic oil in the second cavity 22 of the actuator 2 enters the energy storage part 5 to store the hydraulic energy. Under another condition, the hydraulic energy stored in the energy storage part 5 provides hydraulic energy for other actuators 2.

Those described above are only exemplary embodiments of the present disclosure, and are not intended to limit the present disclosure. Any modification, equivalent substitution, improvement, etc. made within the spirit and principle of the present disclosure should fall within the protection scope of the present disclosure.

The invention claimed is:

1. A backhoe loader energy recovery and reuse system, comprising:

an actuator configured to drive a working device of a backhoe loader to perform an action with hydraulic oil as a medium, the actuator having a first cavity and a second cavity;

a reversing valve, having a first working oil port communicated with the first cavity and a second working oil port communicated with the second cavity, the reversing valve being configured to reverse the actuator;

a stabilizing valve group, having a first oil port, a second oil port, a third oil port, and a fourth oil port, the first oil port and the second oil port being communicated with the first cavity and the second cavity, respectively, and the third oil port being communicated with an oil tank; and an energy storage part, communicated with the fourth oil port and configured to store hydraulic energy;

wherein the first oil port and the third oil port have a first communication state therebetween, in the first communication state, the hydraulic oil in the first cavity can enter the oil tank; the second oil port and the fourth oil port can be selectively connected or disconnected, and in a connected state, the second cavity is communicated with the energy storage part;

wherein the actuator comprises a derricking cylinder configured to drive an excavation arm or a loading arm to rotate in a vertical plane; and wherein the backhoe loader energy recovery and reuse system further comprises a detection component which comprises:

a first displacement sensor, configured to detect a displacement of a piston rod of the derricking cylinder; and a first pressure sensor, configured to detect a pressure in the first cavity of the derricking cylinder.

2. The backhoe loader energy recovery and reuse system according to claim 1, wherein the stabilizing valve group comprises:

a first control valve, having a first position and a second position, the first control valve being configured to make the first oil port and the third oil port in the first communication state when being in the first position, and make the first oil port and the third oil port in a second communication state when being in the second position to prevent the hydraulic oil in the first cavity from entering the oil tank; and a second control valve, having a first position and a second position, the second control valve being configured to make the second oil port and the fourth oil port in the connected state when being in the first position, and make the second oil port and the fourth oil port in a disconnected state when being in the second position.

3. The backhoe loader energy recovery and reuse system according to claim 2, wherein the first control valve is a two-position two-way reversing valve, and a first check valve is disposed on an oil path in a second position between the first oil port and the third oil port, and the first check valve is configured to only allow the hydraulic oil to flow from the third oil port to the second oil port.

4. The backhoe loader energy recovery and reuse system according to claim 2, wherein the second control valve is a two-position two-way reversing valve, a second check valve and a third check valve are disposed on an oil path in a second position between the second oil port and the fourth oil port, the second check valve and the third check valve are oppositely disposed, so that the second oil port and the fourth oil port are in the disconnected state when the second control valve is in the second position.

5. The backhoe loader energy recovery and reuse system according to claim 2, wherein in case that the first control valve is in the first position and the second control valve is in the first position, the actuator simultaneously performs an oil return and an energy recovery or reuse;

in case that the first control valve is in the second position and the second control valve is in the first position, the actuator only performs the energy recovery or reuse; and in case that the first control valve is in the first position and the second control valve is in the second position, the actuator only performs the oil return.

6. The backhoe loader energy recovery and reuse system according to claim 2, wherein the first control valve and the second control valve are electromagnetic valves, and the backhoe loader energy recovery and reuse system further comprises a controller configured to control the first control valve and the second control valve to switch working positions.

7. The backhoe loader energy recovery and reuse system according to claim 6, further comprising a state switch which can be selectively in an open state or a closed state, the state switch being configured to control the stabilizing valve group through the controller to start an energy recovery or reuse in the open state and stop the energy recovery or reuse in the closed state.

8. The backhoe loader energy recovery and reuse system according to claim 7, wherein the state switch is configured to be in the closed state in case that a motion range of the actuator does not exceed a preset range, or a moving speed does not exceed a preset speed, or a load does not exceed a preset load; and in the open state in case that the motion range of the actuator exceeds the preset range, or the moving speed exceeds the preset speed, or the load exceeds the preset load.

9. The backhoe loader energy recovery and reuse system according to claim 1, wherein the actuator comprises at least one of:

a derricking cylinder, configured to drive an excavation arm or a loading arm to rotate in a vertical plane; and two rotary cylinders, which are disposed in series and configured to extend and retract to cooperate with driving of a rotary body of the backhoe loader to rotate.

10. The backhoe loader energy recovery and reuse system according to claim 1, wherein the stabilizing valve group is configured to communicate the second cavity with the energy storage part in case that a detection value of the first displacement sensor exceeds a first preset displacement and a detection value of the first pressure sensor exceeds a first preset pressure.

11. The backhoe loader energy recovery and reuse system according to claim 1, wherein the actuator comprises: two rotary cylinders configured to extend and retract to cooperate with driving of a rotary body of the backhoe loader to rotate; the backhoe loader energy recovery and reuse system further comprises a detection component which comprises:

a second displacement sensor, configured to detect a displacement of a piston rod of the rotary cylinder;

a second pressure sensor, configured to detect a pressure in the first cavity of the rotary cylinder; and a position detection sensor, configured to detect a rotation angular position of the rotary body.

12. The backhoe loader energy recovery and reuse system according to claim 11, wherein the stabilizing valve group is configured to communicate the second cavity with the energy storage part to store energy for the energy storage part, in case that the rotary body swings out to an angle greater than a preset angle and a detection value of the second pressure sensor exceeds a second preset pressure; and communicate the first cavity with the energy storage part to supplement hydraulic oil to the rotary cylinder through the energy storage part, in case that the rotary body swings back to an angle less than the preset angle and the detection value of the second pressure sensor does not exceed the second preset pressure.

13. A backhoe loader, comprising the backhoe loader energy recovery and reuse system according to claim 1.

14. A control method of a backhoe loader energy recovery and reuse system that includes an actuator configured to drive a working device of a backhoe loader to perform an action with hydraulic oil as a medium, the actuator having a first cavity and a second cavity; a reversing valve, having a first working oil port communicated with the first cavity and a second working oil port communicated with the second cavity, the reversing valve being configured to reverse the actuator; a stabilizing valve group, having a first oil port, a second oil port, a third oil port, and a fourth oil port, the first oil port and the second oil port being communicated with the first cavity and the second cavity, respectively. and the third oil port being communicated with an oil tank; and an energy storage part, communicated with the fourth oil port and configured to store hydraulic energy; wherein the first oil port and the third oil port have a first communication state therebetween, in the first communication state, the hydraulic oil in the first cavity can enter the oil tank; the second oil port and the fourth oil port can be selectively connected or disconnected, and in a connected state, the second cavity is communicated with the energy storage part; wherein the actuator comprises a derricking cylinder configured to drive an excavation arm or a loading arm to rotate in a vertical plane; and wherein the backhoe loader energy recovery and reuse system further comprises a detection component which comprises: a first displacement sensor, configured to detect a displacement of a piston rod of the derricking cylinder; and a first pressure sensor, configured to detect a pressure in the first cavity of the derricking cylinder, the method comprising:

receiving at least one of a working state of the actuator and the working device detected by the detection component; and in case that a displacement of the piston rod of the derricking cylinder detected by the first displacement sensor exceeds a first preset displacement, and the pressure in the derricking cylinder detected by the first pressure sensor exceeds a first preset pressure, making the stabilizing valve group in a state of communicating the second cavity with the energy storage part.

15. The control method according to claim 14, wherein the actuator comprises: two rotary cylinders configured to extend and retract to cooperate with driving of a rotary body of the backhoe loader to rotate; in case that a detection result of the detection component reaches a preset condition, making the stabilizing valve group in a state of communicating the second cavity with the energy storage part comprises:

receiving a displacement signal of a piston rod of the rotary cylinder detected by a second displacement sensor to determine a rotation direction of the rotary body;

in a swing out process of the rotary body, in case that a swing angle detected by a position detection sensor exceeds a preset angle and a pressure in the rotary cylinder detected by a second pressure sensor exceeds a second preset pressure, making the stabilizing valve group in a state of communicating the second cavity with the energy storage part to store energy for the energy storage part.

16. The control method according to claim 15, wherein in case that a detection result of the detection component reaches a preset condition, making the stabilizing valve group in a state of communicating the second cavity with the energy storage part further comprises:

in a swing back process of the rotary body, in case that the swing angle detected by the position detection sensor does not exceed the preset angle and the pressure in the swing cylinder detected by the second pressure sensor does not exceed the second preset pressure, making the stabilizing valve group in a state of communicating the first cavity with the energy storage part, so as to supplement hydraulic oil to the swing cylinder through the energy storage part.

* * * * *